United States Patent [19]

Bardsley

[11] 4,241,675

[45] Dec. 30, 1980

[54] MODULAR GAUGE PARTS ASSEMBLY FOR CUT/LOOP TUFTING MACHINES

[75] Inventor: Harold B. Bardsley, Euxton, near Chorley, England

[73] Assignee: Spencer Wright Industries, Inc., Chattanooga, Tenn.

[21] Appl. No.: 91,977

[22] Filed: Nov. 7, 1979

[30] Foreign Application Priority Data

Feb. 22, 1979 [GB] United Kingdom ..... 6373/79

[51] Int. Cl.[3] ..... D05C 15/36

[52] U.S. Cl. ..... 112/79 A

[58] Field of Search ..... 112/79 R, 79 A, 78

[56] References Cited

U.S. PATENT DOCUMENTS

| | | | |
|---|---|---|---|
| 3,075,482 | 1/1963 | Card | 112/79 A |
| 3,595,184 | 7/1971 | Watkins | 112/79 R |
| 4,048,930 | 9/1977 | Card | 112/79 A |

*Primary Examiner*—H. Hampton Hunter

*Attorney, Agent, or Firm*—Alan Ruderman

[57] ABSTRACT

A cut/loop tufting machine looper/clip assembly wherein a pair of body members respectively support a plurality of loopers or clips. The body members have complimentary reference surfaces for co-operative mating engagement of the members and for engagement of a flag on the clip resiliently with the nose of the looper as required for tufting cut pile and loop pile selectively. The body members are secured together to form a modular unit for installation in the tufting machine.

8 Claims, 4 Drawing Figures

MODULAR GAUGE PARTS ASSEMBLY FOR CUT/LOOP TUFTING MACHINES

BACKGROUND OF THE INVENTION

This invention relates to gauge parts for tufting machines, and has more particular reference to looper/clip combinations for use in the selective formation of cut or loop pile.

It is known in the art to use a hook or looper having a spring clip mounted thereon. A part of the clip bears on the bill of the hook or looper adjacent the free end thereof in the production of tufted fabrics having both cut and loop pile. The loop of yarn seized by the hook or looper from the reciprocating needle selectively is retained on the looper by the clip during subsequent reciprocation of the needle and moves rearwardly of the looper bill eventually to be cut by an oscillating knife cooperable therewith to form cut pile or is released from the looper by displacement of the clip by virtue of the tension in the yarn to form loop pile, according to specific requirements.

In conventional loopers having spring clips mounted thereon the clip is formed from flat spring steel strip cut to an appropriate shape and secured to a face of the looper. Adjacent its remote end the clip is formed with a generally triangular enlargement of which the apex bears on the looper bill, and such clip is creased in register with a line of symmetry of the enlargement which passes through the apex thereof, the crease extending towards the plane of that face of the looper to which the clip is secured. The construction is illustrated in U.S. Pat. No. 3,084,645 together with its application in forming cut and loop stitches.

In our co-pending United Kingdom Patent Application No. 448-57/78 (corresponding U.S. Application Ser. No. 91,982 filed Nov. 7, 1979) there is described and illustrated a looper/clip combination wherein that part of the free portion of the clip which corresponds to the effective cutting edge of the bill of the looper is arranged in offset disposition inwardly of the plane of that face of the looper against which the free end of the clip bears in relation to the looper. In the embodiments specifically disclosed in said aforesaid co-pending Application, and in conventional looper/clip combinations such as that combination disclosed in prior United Kingdom Pat. No. 920,024, corresponding to U.S. Pat. No. 3,084,645, the clip is secured to the looper, as by screws or riveting, thus giving rise to a need to discard and to replace as a unit a particular combination in the event of damage to either of the component parts thereof.

In use, the clip is particularly vulnerable to damage, and it is usually the case in practice that damage to a particular clip results in damage to adjacent clips due to a domino effect arising from the close proximity of such adjacent clips.

Bearing in mind that the cost of the clip component is but a relatively small proportion of the total cost of a looper/clip combination, the need to discard such a combination, or indeed a plurality thereof, on account, in the first instance, of damage to or failure of a single clip represents a financial burden out of all proportion to the fault.

Even in those situations where the damaged clip can be removed from a looper and a new one secured thereto, it can only be repaired when removed from the machine and the down-time required for removing and replacing a number of the units can be out of proportion to the damage.

In the utilization of looper/clip combinations to produce cut/loop fabric, yarn tension and component precision effect the quality of the goods produced. If improper and inconsistent tension of the clips against the loopers is present, the resultant product is reflective of this difficulty. Control of these factors becomes significantly more important as the gauge of the tufting machine is reduced. When adjacent loopers are relatively widely spaced apart, manufacturing imprecision can be tolerated to a greater extent than when the gauge is fine. Moreover, the free movement of the parts and interference therebetween clearly creates difficulties when the spacing between adjacent clips and loopers is relatively close.

SUMMARY OF THE INVENTION

It is a primary object of the present invention to provide a looper/clip combination which improves the cost effectiveness of such combinations by minimizing the extent to which components need to be replaced in the event of damage.

It is another object of the present invention to provide a modular looper/clip combination for cut/loop tufting machines.

It is a further object of the present invention to provide a looper/clip combination wherein the loopers and clips are mounted in respective body parts adapted and arranged in such relative disposition that corresponding loopers and clips are supported in a requisite co-operative relationship.

It is a still further object of this invention to provide a looper/clip combination comprising respective body parts for the loopers and clips each supporting or being adapted to support a plurality of loopers or clips in side-by-side disposition thereon, the body parts being adapted for mounting in such relative disposition that corresponding loopers and clips are supported in a requisite co-operative relationship.

It is a yet still further object of this invention to provide a looper/clip combination comprising respective body parts for the loopers and clips, each body part supporting or being adapted to support a plurality of loopers or clips, as appropriate, the body parts being adapted and arranged to cooperate to locate the loopers and corresponding clips in a requisite co-operative relationship.

In carrying out the invention there is provided a pair of body members each respectively supporting a plurality of spaced loopers or clips. The body members have complementary reference surfaces adapted to co-operatively mate and means for securing the body members together. The loopers and the clips are disposed on the respective body member so that when the body members are secured together the clips resiliently are tensioned against the bills of the loopers as required for cut/loop tufting. The loopers and clips may be molded into the respective block to form a standardized module. When one or more of the clips, or loopers, are damaged, the body member carrying the damaged members only need to be replaced. The modules, since the loopers or clips can be assembled in a fixture, can have very accurate component precision. Thus, when the body members are secured together and mounted in a tufting machine yarn handling is precise and consistent.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
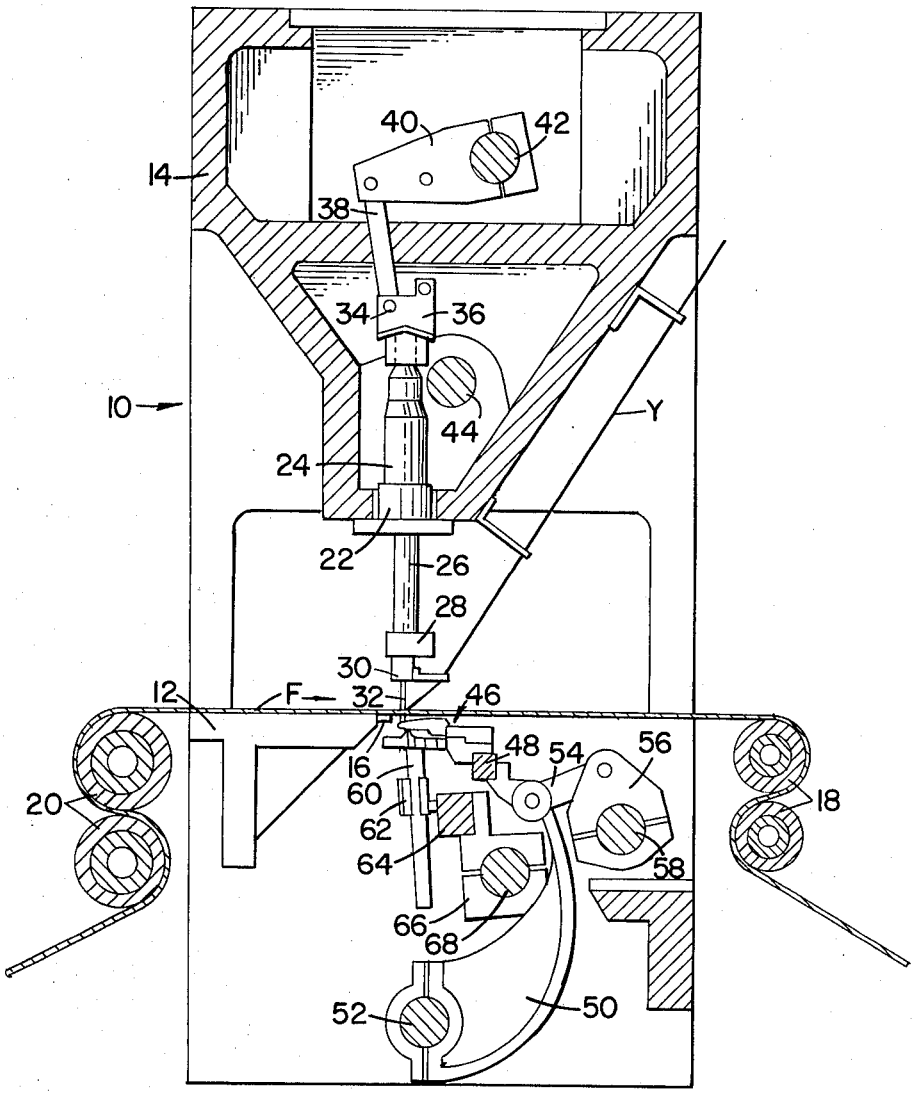
FIG. 1 is a vertical sectional view taken transversely through a multiple needle cut/loop tufting machine incorporating apparatus constructed in accordance with the principles of the present invention.

Referring now to the drawings, there is illustrated in FIG. 1 a tufting machine 10 having a frame comprising a bed 12 and a head 14 disposed above the bed. The bed 12 includes a bed plate 16 across which a backing fabric F is adapted to be fed by a pair of feed rolls 18 and take-off rolls 20.

Mounted in the head 14 are a plurality of collars 22 only one of which is shown, for supporting a respective sleeve 24. Reciprocably mounted within each sleeve is a push rod 26, to the lower end of which a needle bar carrier 28 is attached and which in turn supports the needle bar 30 which carries a multiplicity of needles 32, only one of which is illustrated. The upper end of the push rod 26 is connected by a wrist pin 34 to a connecting member 36 which in turn is connected by a link 38 to a rocker arm 40 on a rock shaft 42. Rocking motion is supplied to the shaft 42 by conventional means such as from a cam shaft 44. A circular cam (not illustrated) is eccentrically fixed to the shaft 44 and drives a lever fixed to the shaft 42 through a connecting rod. Rotational motion of the shaft 44 is thus converted into rocking motion at shaft 42 to reciprocate the push rods 26, the needle bar 30 and the needles 32.

Mounted in the bed 12 for co-operation with the needles to seize loops of yarn presented thereby are a plurality of loopers or hooks generally indicated at 46 which point in the direction opposite to that to which the fabric is fed and to which further reference will be made. The hooks, as hereinafter described, are mounted on hook bars 48 secured to the upper end of a rocker arm 50. Conventionally the rocker arm 50 may be oscillated by a rock shaft 52 clamped at the lower end of the arm and journalled in the bed. Pivotably connected to the upper portion of the rocker arm is one end of a connecting link 54 having its other end pivotably connected between forked arms of a jack shaft rocker arm 56 which in turn is clamped to a jack shaft 58 oscillated by conventional drive means from the shaft 44 in timed relationship with the reciprocation of the needles.

A plurality of knives 60 respectively co-operate with the hooks to cut selected loops to form cut pile. The knives are mounted in knife blocks 62 secured to a knife bar 64 which in turn is secured to a knife shaft rocker arm 66 clamped to a knife shaft 68. Oscillatory movement is imparted to the knife shaft 68 to conventionally drive the knives into engagement with one side of the respective hooks to provide a scissors-like cutting action.

The hook or looper mounting arrangement for the tufting machine comprises a hook or looper 70 and a corresponding clip 72 mounted in respective blocks 74, 76 the looper and clip being so positioned in their respective blocks and the blocks being so mounted one relative to the other that a crease 77 in an upstanding flag 78 on the clip 72, disposed out of the plane of the clip proper, resiliently is in pressure engagement with a nose 80 adjacent the free end of the bill 82 of the looper, which for reasons set forth in U.S. Pat. No. 3,084,645 is required to produce cut and loop pile selectively.

Yarn Y fed to the needles 32 and seized by the looper 70 selectively is retained on the looper by the clip 72 to be eventually cut by the knife 60 to form cut pile or is released from the looper when the yarn is back robbed with sufficient tension to form loop pile.

The particular form of the looper and clip as regards their co-operating parts is preferably as that disclosed in greater detail in the aforesaid co-pending application to which attention is directed. However, if desired the particular form of the looper and clip may be as that disclosed in U.S. Pat. No. 3, 084,645, or of any other convenient form.

Block 74 is of generally rectangular form when viewed in side elevation, and the planar underside is stepped, as at 84 to give a forwardly extending platform 86 within which the mounting portion 88 of the shank 89 of the looper is positioned and preferably is integrally moulded, there being a through hole 90 in the shank more positively to locate and secure the looper in the body. A lug 92 is provided at the underside of block 74 rearwardly of step 84 for a purpose hereafter to be made apparent.

Block 76 is of inverted L-shape, when viewed in side elevation, the planar upper surface thereof being stepped, as at 94, in a manner complementary to the underside of block 74 and for co-operative engagement therewith, the mounting portion 95 of the shank 98 of clip 72 preferably being moulded integrally within block 76 at the forward end thereof. The mounting portion includes a step at 97 more positively to locate the clip in the body and prevent extraction.

A shallow recess 98 is formed in the upper surface of block 76 adjacent the step therein, the said recess being intended to receive the depending lug 92 provided at the underside of block 74 on co-operative engagement of the two blocks.

A counterbored hole 100 is provided in block 74 rearwardly of the inner end of the shank of the looper in register (in the assembled condition of the blocks) with a screw-threaded hole 102 in block 76 to secure the blocks together by means of a screw 103 or the like.

A through hole 104 is provided in the depending flange 106 of block 76 to receive a bolt 108 for mounting such block on the looper bar 48 of the tufting machine. The inverted L-shape of the block 76 being such that it co-operates with the square edge 110 of the bar.

Figure 2:
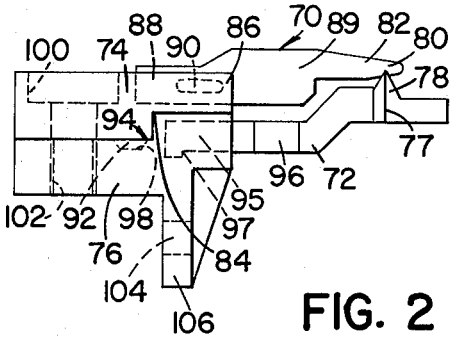
FIG. 2 is an enlarged side elevational view somewhat diagrammatic of a looper/clip combination incorporated in the machine illustrated in FIG. 1.
Figure 3:
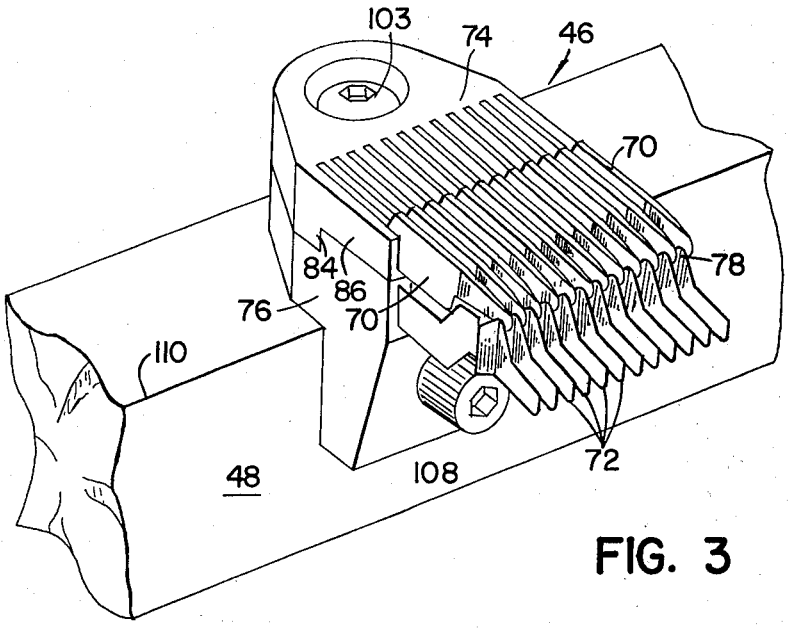
FIG. 3 is a perspective view of typical looper and clip modules secured together providing a plurality of loopers and clips in operative disposition.
Figure 4:
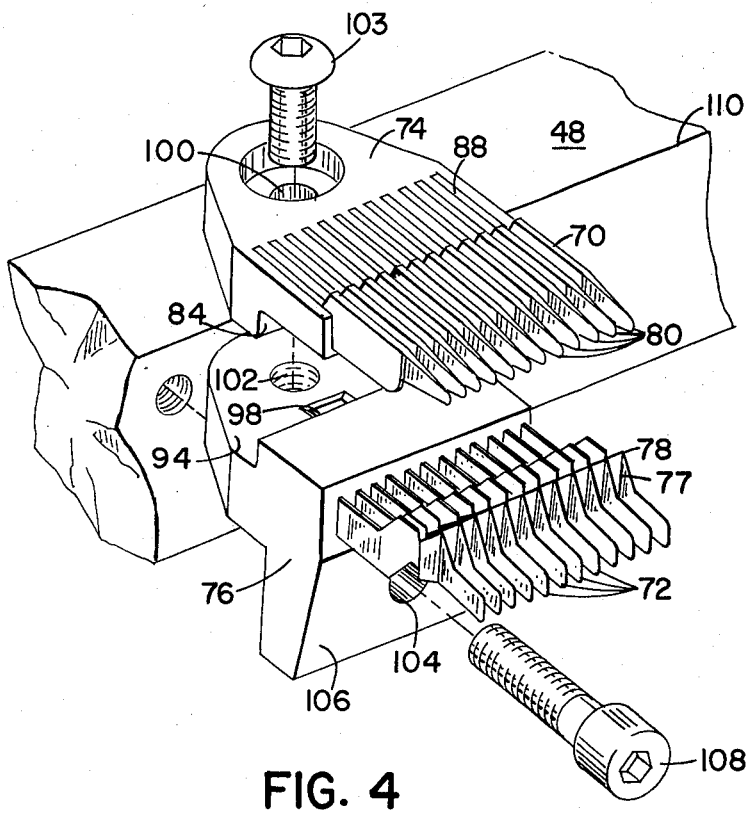
FIG. 4 is a view which corresponds to FIG. 3, with the looper and clip modules disassembled.

Blocks 74,76 will ordinarily be of a dimension sufficient to support a plurality of loopers or clips, as appropriate, in spaced side-by-side disposition. The form and relative disposition of the depending lug 92 and the recess 98 in the upper and lower blocks 74,76 respectively may be such as to provide a means to load the flags 78 of the resilient clips 72 into engagement with the respective looper bills 82 to a requisite amount, as distinct from merely providing a location means as between the two blocks. A typical application of the arrangement shown diagrammatically in FIG. 2 is illustrated in FIGS. 3 and 4, it being understood that a plurality of units or modules comprising blocks 74,76 will be provided in adjacent side-by-side disposition to provide looper/clip combinations in a number and disposition appropriate to specific requirements.

As will readily be appreciated, in the event of failure of or damage to a clip or series thereof, the body parts carrying such clips can be replaced without the need to replace the related loopers, thereby minimising the cost of such replacement. Likewise, any damaged looper or series thereof can be replaced, the cost of replacement being limited to the cost of replacing the damaged loopers and others on the same block or blocks.

The invention is not restricted to the exact features of the embodiment specifically disclosed, since alternatives will present themselves to one skilled in the art. Thus, for example, whilst it is proposed that the loopers and clips be moulded integrally with their respective body parts, it may be preferred, in some instances, that the body parts be formed in such manner as to be capable of receiving and locating the loopers and clips, this being particularly so as regards the looper body part.

Furthermore, the invention is not limited to the context of clips of the kind hereindisclosed, and described in greater detail in the co-pending Application aforesaid, and is of like application to other looper/clip combinations, subject, of course, to any necessary modification of the shanks of the loopers and clips to render them suitable for use in accordance with the principles of the invention.

Thus, numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A modular assembly for supporting loopers and spring clips adapted for mounting in a tufting machine for producing cut and loop pile selectively, said assembly comprising, a plurality of loopers, each looper having a shank including a mounting portion at one end and a bill extending therefrom terminating in a nose, a first body member, said first body member having means for receiving and securing the mounting portion of said loopers in spaced side-by-side disposition, a plurality of spring clips, there being one clip for each looper, said clips having a shank including a mounting portion at one end and extending toward an offset flag, a second body member, said second body member having means for receiving and securing the mounting portions of said spring clips in spaced side-by-side disposition, the spacing between adjacent clips being substantially the same as the spacing between adjacent loopers, said first and second body members having means defining complementary reference surfaces disposed relative to the disposition of said loopers and said clips for co-operative engagement of said body members and for engagement of each flag resiliently with the nose of a respective looper, and means for securing said body members together as a unit in co-operative engagement.

2. A modular assembly as recited in claim 1 wherein said complementary reference surfaces each comprise a pair of planar surfaces joined at a step in the respective body member.

3. A modular assembly as recited in claim 1 wherein the reference surface of said first body member is disposed on the bottom thereof and said reference surface of said second body member is disposed on the top thereof, whereby said first body member is positioned on the second body member, said flag being disposed on said clip above the clip mounting portion.

4. A modular assembly as recited in claim 3 wherein said reference surfaces include a respective co-operative male and female formation.

5. A modular assembly as recited in claim 1 wherein said loopers and clips are molded into the respective body member.

6. A modular assembly as recited in claim 2 wherein the reference surface of said first body member is disposed at the bottom thereof, said step and one planar surface providing the underside of a platform, said loopers being positioned in said platform.

7. A modular assembly as recited in claim 1 wherein said mounting portions of said loopers and clips include means for locating said portions in the respective body member.

8. A modular assembly as recited in claim 1 wherein said second body member includes means adapted to secure the assembly as a unit in a tufting machine.

* * * * *